United States Patent [19]

Molaire et al.

[11] 4,419,434

[45] Dec. 6, 1983

[54] IMAGE TRANSFER FILM UNIT WITH MODIFIED SURFACE LAYER CONTAINING CAPILLARIES

[75] Inventors: Michel F. Molaire, Rochester; John V. Williams, Pittsford, both of N.Y.

[73] Assignee: Eastman Kodak Company, Rochester, N.Y.

[21] Appl. No.: 451,320

[22] Filed: Dec. 20, 1982

[51] Int. Cl.[3] ..... G03C 1/76; G03C 1/48; G03C 1/40; G03C 5/54

[52] U.S. Cl. ..... 430/207; 430/403; 430/496; 430/961; 354/303; 354/317

[58] Field of Search ..... 430/207, 403, 496, 499, 430/950, 961; 354/303, 317

[56] References Cited

U.S. PATENT DOCUMENTS

| | | | |
|---|---|---|---|
| T880,011 | 11/1970 | Jaskowski | 430/496 |
| 2,602,742 | 7/1952 | Buskes et al. | 430/496 |
| 3,069,266 | 12/1962 | Land | 430/207 |
| 3,784,382 | 1/1974 | Liang | 430/212 |
| 4,233,029 | 11/1980 | Columbus | 23/230 R |
| 4,271,119 | 1/1981 | Columbus | 422/50 |

FOREIGN PATENT DOCUMENTS

| | | |
|---|---|---|
| 2042753A | 9/1980 | United Kingdom . |

*Primary Examiner*—Richard L. Schilling
*Attorney, Agent, or Firm*—Carl O. Thomas

[57] ABSTRACT

An image transfer film unit is disclosed in which a surface capillary layer is provided to supply processing liquid uniformly to an imaging portion of the film unit.

10 Claims, 5 Drawing Figures

IMAGE TRANSFER FILM UNIT WITH MODIFIED SURFACE LAYER CONTAINING CAPILLARIES

FIELD OF THE INVENTION

This invention relates to novel photographic film units. More specifically, this invention relates to image transfer film units which are capable of forming a viewable transferred image.

BACKGROUND OF THE INVENTION

In image transfer photography processing liquid is released into contact with one or more imagewise exposed radiation-sensitive imaging layers located on a photographic support. The imaging layers are capable of providing mobile image-forming material during processing in a pattern which is a direct or inverse function of imagewise exposure. A receiving layer is located adjacent the imaging layers during processing to receive the image-forming material and to form a viewable transferred image.

(a) The Problem Addressed by the Invention

In the most common image transfer film unit constructions it is desirable to provide a thin, uniform layer of processing liquid over at least the entire area of the image transfer film unit in which a viewable image is intended to be formed. Nonuniformities in the processing liquid often translate into nonuniformities in the transferred image.

A further complication is introduced by further requiring that the image transfer film unit have the capability of being handled during processing. This requires the processing liquid to be entirely contained within the film unit. Thus, in most instances image transfer film units capable of being handled during processing include both a support and a cover sheet that are impervious to processing liquid.

In integral image transfer film units the processing liquid is sealed within the unit before, during, and after processing. Most commonly, the processing liquid is initially contained in a reservoir or pod laterally displaced from the area of the unit intended to form a viewable image. After imagewise exposure of the unit the processing liquid is released from the pod by passing the unit between pressure rollers intended to spread the processing liquid uniformly within the viewable image-forming area of the element. Both a cover sheet and a support are required to confine and laterally direct the processing liquid. Both the cover sheet and the materials forming the pod increase the film unit's bulk, which some users find unattractive.

(b) Specific Prior Art Relevant to the Problem or Most Nearly Analgous to the Inventive Structure Land U.S. Pat. No. 3,069,266 teaches mounting a support having a silver halide emulsion layer coated thereon in proximity to a support having a receiving layer thereon to form a capillary interspace therebetween. Upon release of processing liquid from a laterally displaced reservoir or pod the processing liquid is drawn by capillary action into the interspace and thereby distributed between the emulsion and receiving layers. Columbus U.S. Pat. Nos. 4,233,029 and 4,271,119 provide additional illustrations of transporting liquid by capillary action.

Liang U.S. Pat. No. 3,784,382 discloses an image transfer film unit having an internal support. Specifically, Liang discloses interposing a porous polymeric support having a porosity between about 1 and 25 percent between silver halide emulsion layers and a dye imaging receiving layer. Liang states, "Since the image-forming dyes travel through the porous support which contains straight-through pores, the dyes reach the dye image-receiving layer with a minimum of lateral diffusion, thereby producing an image having greater sharpness."

Whitmore U.K. patent application No. 2,042,753A discloses image transfer film units in which radiation-sensitive silver halide can be located in closed-end microcells embossed or otherwise formed in the photographic support. Additionally or alternatively an image receiving material, such as a mordant, can be positioned in closed-end microcells embossed or otherwise formed in a cover sheet. Processing liquid is introduced between the support and cover sheet in a conventional manner.

Jaskowsky Defensive Publication T880011 discloses an imaging element wherein a layer containing an imaging dye or pigment in pores extending between its major surfaces is mounted so that each pore at one terminus lies adjacent a deformable resin layer which in turn lies adjacent a diazo blowing agent. Each pore at its remaining terminus contacts a semi-permeable membrane which in turn overlies a receiving manner. When the diazo blowing agent is exposed to light, gas is explosively generated causing the deformable resin layer to impinge on the porous layer containing dye or pigment. This in turn forces dye or pigment from the pores in this area, and the dye or pigment traverses the semi-permeable membrane to form a viewable image in the receiving member.

SUMMARY OF THE INVENTION

In one aspect this invention is directed to an image transfer film unit comprised of a support and, located on said support, an imaging portion comprised of radiation-sensitive imaging means capable of providing mobile image-forming material as a function of exposure and means for receiving the mobile image-forming material from said imaging means to form a viewable transferred image. A capillary surface layer is provided overlying the imaging portion and forming an array of open-ended capillaries for uniformly supplying processing liquid to the imaging portion. The capillaries subtend within the image viewing area of the image transfer film unit more than half the area of the capillary surface layer.

It is an advantage of the image transfer film units of this invention that processing liquid can be conveniently and reliably uniformly introduced without the use of pressure rollers or other liquid spreading apparatus. It is a further advantage of the present invention that image transfer film units can be handled during processing without the requirement of a cover sheet. It is a still further advantage of the present invention that an integral image transfer film unit construction can be employed without incorporating a reservoir for processing liquid laterally displaced from the image viewing area of the unit.

DESCRIPTION OF THE DRAWINGS

These and other advantages of the invention can be better appreciated by referring to the following detailed description of preferred embodiments considered in conjunction with the drawings, in which.

Figure 1:
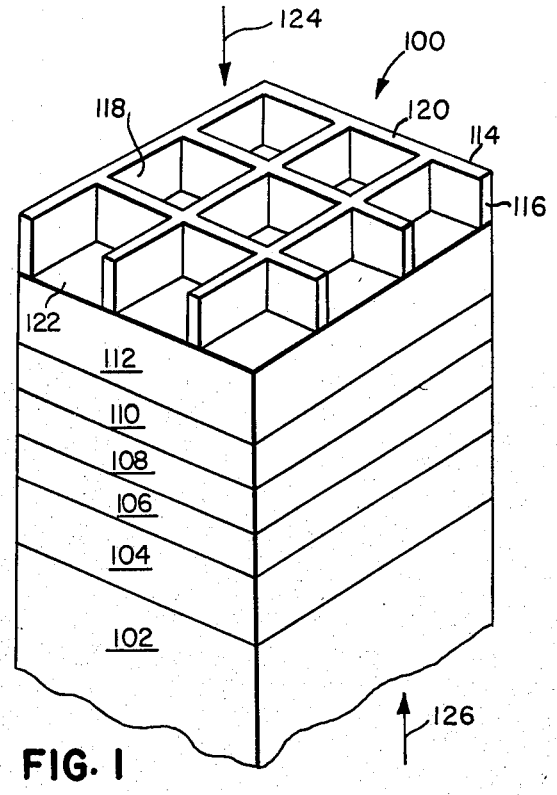
FIG. 1 is a detail, partly in section and with portions broken away, of a preferred image transfer film unit according to this invention.

In the drawings the size of the capillary surface layers and other portions of the image transfer film units have been greatly enlarged for ease of illustration. The drawings are schematic in nature and are not drawn to scale.

DESCRIPTION OF PREFERRED EMBODIMENTS

In FIG. 1 a preferred image transfer film unit 100 according to this invention is illustrated. A conventional transparent support 102 is only partially shown, since its thickness is large as compared to that of the remaining layers of the film unit. On the support conventional process control layers, such as the combination of an acid layer and a timing layer, are represented at 104. A receiving layer 106, such as a conventional silver receiving layer or a conventional dye image receiving layer—e.g., a mordant—is shown overlying the process control layers. A conventional reflecting layer 108 is shown overlying the receiving layer to permit a transferred image in the receiving layer to be viewed through the transparent support. A conventional liquid permeable opaque layer 110 is located above the reflecting layer. Layer unit 112 located above the opaque layer 110 schematically indicates one or more conventional radiation-sensitive imaging layers. The layer unit can additionally include conventional liquid permeable protective layers and interlayers. The layer unit is capable of providing one or more mobile imaging materials as a direct or inverse function of exposure.

A capillary surface layer 114 according to this invention is shown overlying the layer unit 112. The capillary surface layer is formed of a plurality of interconnecting lateral walls 116 which form a planar array of open-ended capillaries 118 extending from an outer surface 120 of the image transfer film unit to an adjacent planar surface 122 of the imaging portion layer unit. The surfaces 120 and 122 are substantially parallel. Hence the capillaries are each of substantially the same depth. Within the areal portion of the image transfer film unit intended to present a viewable image the capillaries account for a major portion of the total area subtended by the capillary surface layer.

In use, the image transfer film unit is imagewise exposed from the direction indicated by the arrow 124. Exposing radiation strikes the surface 122 of the imaging portion layer unit 112 primarily by passing uninterrupted through the capillaries 118, since the capillaries subtend more than half of the total area of the cpaillary surface layer in portions of the image transfer film unit intended to present a viewable image. It is generally preferred that the capillaries subtend greater than 70 percent, most preferably greater than 90 percent up to the highest readily achievable percentage, about 97 percent, of the total imaging area presented by the capillary surface layer. Some of the imaging radiation strikes the lateral walls 116. When, as in a preferred form, the lateral walls are themselves transparent, the imaging radiation is transmitted through the lateral walls between the surfaces 120 and 122 with only minimal distortion. It is not, however, essential that the lateral walls be transparent or substantially so, this being more specifically discussed below. Upon receipt of the imaging radiation the imaging portion of layer unit 112 forms a latent image which can be converted to a viewable transferred image upon processing. The opaque layer 110 acts as an antihalation layer during imagewise exposure.

To commence processing a conventional liquid, such as a conventional photographic developer or, when the image transfer film unit contains an incorporated developing agent, a conventional activator, is brought into contact with the surface 120 of the capillary surface layer. Each capillary contacted by the processing liquid is filled with liquid by capillary attraction. Since the surfaces 120 and 122 are substantially parallel, the capillaries are of substantially the same height and present a substantially uniform volume across the entire viewable image-forming surface of the image transfer film unit. Since the capillaries in the preferred form shown in FIG. 1 form an array of substantially equal volume capillaries, it is apparent that the processing liquid is substantially uniformly presented to the surface 122 of the imaging unit. Thus, spreading nonuniformities often encountered by employing conventional spreading techniques on a planar surface of a conventional image transfer film unit are minimized.

In the specific image transfer film unit 100 shown in FIG. 1 the processing liquid preferably contains an opacifying agent so that the film unit can be handled during processing without taking other precautions against further exposing the radiation-sensitive imaging portion layer unit. The layer unit is protected from exposure through the transparent support by the opaque layer 110 supplemented by the reflecting layer 108.

As the processing liquid penetrates the layer unit 112 and the layers 110, 108, and 106, mobile image-forming material released from the layer unit 112 migrates through the opaque layer 110 and reflecting layer 108 to the receiving layer 106. Some lateral diffusion of the mobile image-forming material occurs during diffusion, as is well recognized by those skilled in the art. Consequently, if the lateral walls 116 of the capillary surface layer have intercepted some exposing radiation during imagewise exposure of the film unit, this may not be visually detectable or objectionable in the transferred image formed in the receiving layer, provided the lateral walls account for a small proportion of the total area subtended by the capillary surface layer within the image viewing area. Lateral deflection of exposing radiation can also contribute toward reducing the visibility of the lateral walls.

Once a transferred image has been produced for viewing in the receiving layer, the interaction of the processing liquid with the process control layers schematically indicated at 104 can be relied upon to terminate processing. For example, the processing liquid can penetrate a conventional timing layer to reveal an acid layer. This can result in lowering the pH of the processing liquid so that further development and/or release of mobile imageforming material in the imaging portion is terminated.

The transferred image can be viewed in the receiving layer through the transparent support 102 from the direction indicated by the arrow 126. Although the factors indicated above can result in minimizing the visual effect of the capillary surface layer on the transferred dye image to be viewed, two additional features of the capillary surface layer are important in minimizing its visual impact on the transferred image. The visual sensation of nonuniformity in a photographic image, noise, is termed graininess. As explained by T. H. James, *The Theory of the Photographic Process,* 4th Ed., Macmillan, 1977, pp. 618 and 619, graininess is a function of both the degree of order in placement of image nonuniformities as well as their size. The present invention controls both the size and order of the capillaries to reduce their visual impact on the transferred image. First, the capillaries are arranged in the capillary surface layer in an array. That is, they have an ordered rather than random placement. Thus, the ordered nature of the capillaries performs both the advantageous function of supplying the processing liquid uniformly as well as reducing graininess. Second, the capillaries are of a smaller size than can be readily individually resolved by the eye. The capillaries are in all instances less than 200 microns in width, preferably less than 150 microns in width. Generally the smallest size capillaries that can be constructed are useful in the practice of this invention. Capillaries having widths of from about 2 to 200 microns are contemplated, with capillary widths of from about 5 to 150 microns being preferred.

In addition to supplying processing liquid uniformly to the imaging portion of the image transfer film unit the capillary surface layer allows the image transfer film unit to be handled during processing without requiring a cover sheet. By drawing the processing liquid into the capillaries 118 the image transfer film unit can be handled without bringing the processing liquid into contact with the skin. The processing liquid that initially enters the capillaries is restrained from leaving the film unit by surface tension forces, often referred to as capillary action. Upon entering the capillaries the processing liquid upon contact immediately begins to permeate the underlying imaging portion of the film unit. By the time the film unit is available for handling—for example, upon ejection from a camera—the level of the processing liquid in the capillaries is already reduced well below the surface 120. In fact, where underlying layer permeability is high, by the time the film unit is first available to be touched no processing liquid may remain above the surface 122.

It is possible to accelerate the rate at which the processing liquid leaves the capillaries and permeates the underlying layers by providing a highly permeable layer just beneath the capillaries to receive initially the processing liquid. For example, a hydrophilic colloid layer, such as a gelatin or gelatin derivative layer, can readily perform this function. Further, if the capillary surface layer is at least partially unbonded to the underlying surface 122, displacement of air initially present in the capillaries is facilitated.

The depth of the capillaries can be varied over a wide range. In one preferred form the capillary depth is chosen so that each capillary when filled contains just the amount of processing liquid needed by the underlying portions of the image transfer film unit. Capillaries having a ratio of height to width of up to 2:1 are contemplated, with height to width ratios of up to 3:2 being preferred for ease of construction.

As the height of the capillaries is reduced, their volume is also reduced. If the volume of the capillaries is less than the minimum volume of processing liquid required for processing, the processing liquid can be introduced into the capillaries in sequential stages. For example, the capillaries can be filled initially with processing liquid. Then, after delaying to allow the processing liquid to leave the capillaries by permeating the underlying layers of the image transfer film unit, the capillaries can be filled again with processing liquid. The filling process can be repeated as many times as required to provide the necessary processing liquid. In each application the processing liquid is supplied uniformly to the image transfer film unit, since each capillary accepts only its proportionate share of the processing liquid.

To avoid excess repetitions in supplying processing liquid it is generally preferred that the capillaries have a height of at least about 5 microns and preferably at least 20 microns. Optimum heights for the capillaries are in the range of about 50 to 200 microns for applications in which processing liquid is supplied in a single filling step.

The capillaries can be filled using any convenient technique. In perhaps the simplest approach the image transfer film unit can be simply immersed in a body of processing liquid. Alternatively the processing liquid can be applied to the capillary surface layer using a conventional liquid applicator, such as a brush, coating knife, or other flow director. The image transfer film unit can be drawn beneath a pressure roller to spread the processing liquid onto the capillary surface layer. Unlike spreading processing liquid on a planar surface, care need not be taken to supply processing liquid uniformly to the capillaries, since each capillary will attract and hold only its proportionate share of processing liquid. Thus, the capillaries themselves rather than the applicator exercise primary control over the uniformity with which processing liquid is introduced into the image transfer film unit.

It is a distinct advantage of the present invention that the capillaries attract and contain processing liquid independent of the orientation of the image transfer film unit during its contact with the source of processing liquid. Stated another way, the surface tension forces drawing the processing liquid into the capillaries are so much stronger than the gravitational forces on the processing liquid that the relative effect of gravitational forces are generally negligible. For this reason the invention is particularly well suited for in-camera initial contact of the processing liquid and image transfer film unit.

Although the invention has been described above with reference to a specific, preferred embodiment, it is appreciated that the image transfer film units of this invention can take a variety of forms. For example, in the image transfer film unit 100 the arrangement 102, 104, 106, 108, 110, 112, and 114, can readily be changed to 102, 104, 112, 110, 108, 106, and 114. In this instance imagewise exposure occurs through the transparent support while viewing occurs through the capillary surface layer.

Figure 3:
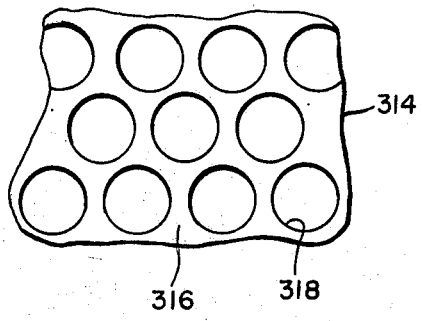
FIGS. 2, 3, and 4 are plan views of small portions of alternative surface capillary layers.
Figure 2:
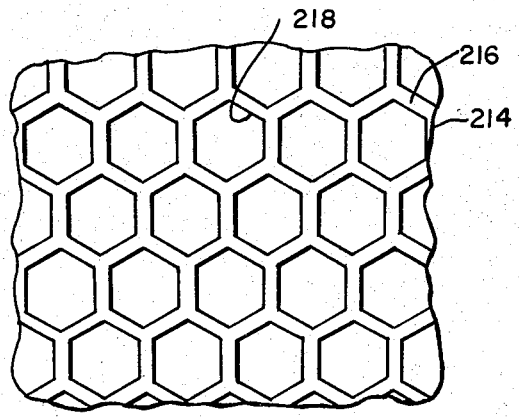
Figure 4:
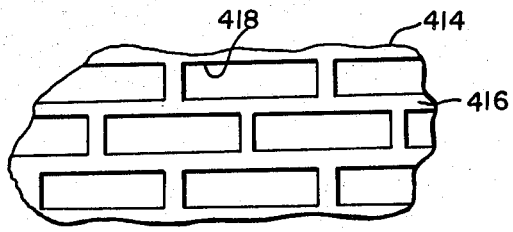

Although the capillaries 118 are shown to be square, it is appreciated that the capillaries can take any convenient geometrical shape. This is illustrated in FIGS. 2, 3, and 4, wherein corresponding features are assigned in the 200, 300, and 400 series, respectively, reference numerals corresponding to the 100 series reference numerals in FIG. 1. In FIG. 2 the capillaries 218 in the capillary surface layer 214 are hexagonal. The hexagonal capillary configuration represents a preferred embodiment of the invention both because of the uniform widths of the lateral walls 216, which efficiently utilizes capillary surface layer area, and because each individual capillary is surrounded by six directly adjacent capillaries, allowing for greater compensation should any individual capillary fail to fill with processing liquid. In FIG. 3 the capillaries 318 in capillary surface layer 314 are circular. The lateral walls 316 of the capillary surface layer vary continuously in width, and the arrangement is therefore somewhat less efficient in maximizing the surface area subtended by the capillaries. However, circular capillaries can be generated by a greater variety of techniques than polygonal capillaries. In FIG. 4 the capillary surface layer 414 is provided with rectangular capillaries 418. The width of the capillaries, the shorter dimension visible in FIG. 4, should be within the size ranges discussed above. The length of the capillaries, the longer dimension visible in FIG. 4, can exceed the size ranges of the capillaries discussed above. In one form individual capillaries can extend across the entire viewable image area of the image transfer film unit. When the length of the capillaries is extended as compared to their width, the capillaries act to spread processing liquid within the area subtended by each individual capillary as well as to distribute processing liquid uniformly to the underlying layers of the image transfer film unit. In this form the capillaries 418 differ in function from the remaining capillaries described above, since the capillaries 118, 218, and 318, by reason of their circumscribed area, effectively prevent processing liquid from significant lateral spreading. In a preferred form of the invention the average of the length and width of the rectangular capillaries is within the size ranges discussed above. Stated in another way, the rectangular capillaries are preferably similar in volume to the capillaries of less laterally extended configuration. Other capillary configurations such as triangular, elliptical, and composite shape capillaries are possible.

The capillary surface layer of the image transfer film unit can be formed from any one of a variety of conventional materials capable of lending themselves to capillary formation. In one preferred embodiment of the invention the capillary surface layer is formed by spreading a negative-working photoresist composition to form an outer layer of the image transfer film unit. Imagewise exposure of the negative-working photoresist composition to ultraviolet radiation in the areas corresponding to the lateral walls and subsequent washing results in the completed capillary surface layer containing the capillary array formed therein.

If the imaging portion of the image transfer film unit is responsive to ultraviolet radiation, as is silver halide, for example, and is positioned so that it would otherwise receive the ultraviolet radiation used to expose the photoresist layer, it is necessary to protect the imaging portion from exposure by providing a light transparent ultraviolet absorbing layer beneath the photoresist layer. A variety of useful ultraviolet absorbers and layers containing them are known in the art. Specific useful ultraviolet absorbers are the cyanomethyl sulfone-derived merocyanines of Oliver U.S. Patent 3,723,154; the thiazolidones, benzotriazoles, thiazolothiazoles of Sawdey U.S. Pat. Nos. 2,739,888, 3,253,921, and 3,250,617 and Sawdey et al U.S. Patent 2,739,971; the triazoles of Heller et al U.S. Pat. No. 3,004,896; and the hemioxonols of Wahl et al U.S. Pat. No. 3,125,597 and Weber et al U.S. Pat. No. 4,045,229. The ultraviolet absorbers can, if desired, be mordanted, as illustrated by Jones et al U.S. Pat. No. 3,282,699 and Heseltine et al U.S. Pat. Nos. 3,455,693 and 3,438,779. In the image transfer film unit 100, for example, an ultraviolet absorbing layer can be interposed between the capillary surface layer 114 and the imaging portion layer unit 112 when the former is formed from a negative-working photoresist composition. However, when the layer unit 112 and the receiving layer 106 are interchanged in position as described above, the radiation-sensitive imaging portion layer unit is separated from the capillary surface layer by the opaque layer 110, and no ultraviolet absorbing layer is needed.

Instead of using an ultraviolet absorbing layer to protect the imaging portion layer unit from exposing radiation in preparing the capillary surface layer, it is contemplated that the photoresist layer can be exposed and processed separate from the remainder of the image transfer film unit and thereafter the capillary surface layer so formed can be joined to complete the film unit. In a variant approach the photoresist layer can be imagewise exposed to ultraviolet radiation while separate from the remainder of the film unit and joined to the film unit prior to processing to complete the formation of capillaries therein.

The negative-working photoresist compositions producing the highest ratios of lateral wall height to width have been obtained using photoresist compositions containing photopolymerizable compounds. By reducing lateral wall width for a given capillary depth, the percentage of the total capillary surface layer area subtended by the capillaries is increased. Thus, the preferred capillary surface layers are those formed using photoresist compositions containing photopolymerizable compounds.

A variety of photopolymerizable compound containing photoresist compositions useful in the practice of this invention are known to the art. Such compositions include an addition polymerizable compound—that is, a compound which contains ethylenic unsaturation and is capable of polymerizing in direct response to ultraviolet exposure or, preferably, in response to one or more photoresponsive polymerization initiators, typically a photosensitizer used alone or, most preferably, in combination with an activator.

Useful addition polymerizable compounds include polymers containing end groups or pendant groups terminating with ethylenic unsaturation. For example, addition polymerizable compounds include polymers of the structure:

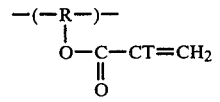

wherein

R is a moiety capable of forming the backbone of a polymer and

T is hydrogen or methyl.

Among preferred addition polymerizable compounds are also simple compounds (i.e., monomers) containing ethylenic unsaturation, such as acrylates, acrylamides, methacrylates, methacrylamides, acrylonitriles, allyl compounds, vinyl ethers, vinyl esters, N-vinyl compounds, styrenes, and crotonates, all well known in the photoresist art. Attention is directed to U.K. Pat. No. 1,534,137 and U.S. Pat. No. 3,759,807, for example, both here incorporated by reference.

Highly preferred as addition polymerizable compounds are the acrylate compounds as a class. Particularly useful examples include alkyl acrylates and methacrylates containing from 1 to about 10 and most preferably 1 to about 5 carbon atoms in the alkyl portion, such as methyl acrylate, ethyl methacrylate, and n-butyl methacrylate; pentaerythritol tri- and tetraacrylates and methacrylates; esters of polyols including glycol diacrylates and dimethacrylates such as tripropylene glycol diacrylates, tetraethylene glycol diacrylate, and triethylene glycol dimethacrylate; alkanediol diacrylates such as hexanediol diacrylates; polyether diacrylates such as obtainable from UCB, a division of Chimique Chaussee de Charleroi, Brussels, Belgium, under the trade name "Ebecryl 210;" and mixtures of the above.

Polymerization initiators are preferably employed in combination with the addition polymerizable compounds. Michler's ketone admixed with benzophenone is a co-initiator combination well known in the art. Activators useful as initiators additionally include amines, acetic acid derivatives, phosphines, phosphites, bismuthines, arsines, stilbines, sulfinic acids and sulfinic acid esters, sulfones, dicarbonyls, such as 2,3-bornanedione and acetylacetone, ketones such as fluorenone and 1,4-quinones, bi-imidazoles, and stannates.

Photosensitizers particularly useful as co-initiators in combination with the above activators are 3-ketocoumarins. Particularly preferred 3-ketocoumarin photosensitizers are those exhibiting maximum absorption between about 250 and 550 nm and having a $$-\overset{\overset{\displaystyle O}{\|}}{C}-R^1$$

substituent in the 3-position wherein $R^1$ is alkyl or alkenyl having 1 to about 12 carbon atoms or a carbocyclic or heterocyclic group having about 5 to 20 ring atoms.

Inhibitors can be incorporated into the photoresist composition to prevent spontaneous polymerization of the photopolymerizable compounds in the absence of exposure. Preferred inhibitors include hydroxy-substituted phenyl moieties, such as hydroquinones, bis(3-t-butyl-4-hydroxy-5-methylphenyl)sulfide, and pyrocatechol.

When binders are desired as an additional component, they can be selected from among a variety of polymers of known utility as vehicles or vehicle extenders in image transfer film unit layers, such as poly(vinyl lactams), acrylamide polymers, poly(vinyl alcohol) and its derivatives, poly(vinyl acetals), polymers of alkyl and sulfoalkyl acrylates, polyamides, poly(vinylpyridine), acrylic acid polymers, maleic anhydride copolymers, poly(alkylene oxides), methacrylamide copolymers, polyvinyloxazolidinones), maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinylimidazole copolymers, vinyl sulfide copolymers, halogenated styrene polymers, amineacrylamide polymers, and polypeptides, such polymers being more specifically disclosed by the patents cited in *Research Disclosure,* Vol. 176, December 1978, Item 17643, Paragraph IX, here incorporated by reference. *Research Disclosure* and *Product Licensing Index* are publications of Industrial Opportunities Ltd.; Homewell, Havant; Hampshire, P09 1EF, United Kingdom. Such binders are not needed when the polymerizable compound and initiator, if any, are sufficiently film-forming in and of themselves—e.g., when the polymerizable compound is a compound of relatively high molecular weight such as an oligomer or a polymer.

Plasticizers can be incorporated in the photoresist composition, depending upon the specific application, but are not usually preferred, since the photoresists are usually more sensitive in their absence.

The photoresist composition as coated additionally includes a suitable solvent. Typical examples of preferred solvents include halogenated hydrocarbons, such as dichloromethane; ketones, such as acetone; alcohols, such as ethanol; ethers, such as diethyl ether; and aromatic hydrocarbons, such as benzene, toluene, and xylene. The specific choice of solvent will, of course, depend on the other ingredients of the photoresist composition. The solvents can also be used to wash away photoresist composition in unexposed areas during processing.

Specific preferred negative-working photoresist compositions which illustrate various of the components described above as well as the useful and preferred relative proportions of components are disclosed by Specht et al U.S. Pat. Nos. 4,147,552, 4,278,751, and 4,289,844 as well as *Research Disclosure,* Vol. 200, December 1980, Item 20036.

While the capillary surface layers are preferably formed by negative-working photoresists such as those described above, other techniques for producing the capillary surface layers are specifically contemplated. For example, the techniques described in Whitmore U.K. patent application 2,042,753A, cited above and here incorporated by reference, though directed to producing close-end microcells, can be adapted to producing open-ended capillaries. For example, the embossing technique of Whitmore can be modified for producing the open-ended capillaries required for the practice of this invention. If an embossing tool having projections corresponding to the shape and height of the desired capillaries is used to form capillaries in a deformable plastic layer, such as a layer of any one of the vehicle or vehicle extender polymers recited above, the result will be to form capillaries that contain a thin plastic end layer adjacent the surface 122 inhibiting processing liquid communication with the underlying layers of the image transfer film unit. However, by providing an additional layer of a processing liquid permeable material, such as a hydrophilic colloid—e.g., gelatin or a gelatin derivative (see *Research Disclosure,* Item 17643, Paragraph IX, cited above), and extending the height of the embossing tool projections to exceed the thickness of the capillary surface layer, open-ended capillaries capable of permitting liquid diffusion into underlying layers of the image transfer film unit can be produced.

Figure 5:
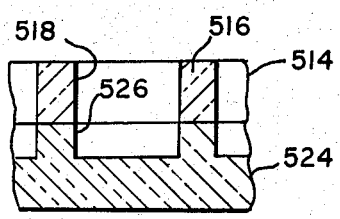
FIG. 5 is a sectional detail of a capillary surface layer and an underlying layer.

The resulting composite of the capillary surface layer and the underlying deformable layer can be better appreciated by reference to FIG. 5. The capillary surface layer 514 contains open-ended capillaries 518 formed by lateral walls 516. The underlying deformable layer 524 contains closed-end capillaries 526 which form continuations of the capillaries in the overlying capillary surface layer. Although not shown in FIG. 5, some relatively liquid impermeable material forming the lateral walls of the capillary surface layer may be deflected by the embossing tool into the closed-end capillaries. However, by routine adjustment of the relative height of the open and closed-end capillaries, closed-end capillaries can be produced having at least their bottom walls substantially free of liquid impermeable material from the overlying capillary surface layer.

Still another technique for preparing capillary surface layers as required by the present invention is by etching. For example, radiation etching of the capillary surface layer to form open-ended capillaries therein can be undertaken. Cellulose nitrate and cellulose esters (e.g., cellulose acetate and cellulose butyrate) are illustrative of plastics which are particularly preferred for use. Etching can be achieved using alpha particles and similar fission fragments, as disclosed, for example, by Sherwood U.S. Pat. No. 3,501,636, here incorporated by reference.

From the diversity of techniques available for forming the capillary surface layer, it is apparent that this layer can be formed of a variety of different materials. It is preferred that the materials forming the lateral walls of the capillaries be hydrophobic. This causes the processing liquid entering the capillaries to form a convex miniscus. When the processing liquid does not wet the capillary walls, air entrapment in the capillaries during processing liquid introduction is obviated. Fortunately, most organic film forming polymeric materials are to varying extents hydrophobic. Extremely high levels of hydrophobicity, such as demonstrated by halogenated hydrocarbon polymers, can impede liquid entry into the capillaries and are not preferred.

It is generally preferred that the material forming the capillary surface layer and the processing liquid be chosen so that when the material to be used in forming the capillary surface layer is coated as a planar layer and a drop of processing liquid is placed thereon a contact angle of less than about 45°, preferably less than about 20° is observed. Contact angles can be lowered by the introduction of surfactant into the processing liquid. Procedures for measuring liquid contact angles are generally known to those skilled in the art.

The materials forming the remaining portions of the image transfer film units can be identical to those heretofore known in the art of image transfer photography and are therefore not considered to require detailed description. The image transfer film units of this invention preferably employ radiation-sensitive silver halide emulsions in their imaging portions and can form silver or dye transferred images for viewing. Multicolor transferred dye imaging is specifically contemplated. Those skilled in the art will readily recognize features compatible with the image transfer film units of this invention, including the processing liquids, to be disclosed in *Research Disclosure,* Item 17643, cited above, Paragraph XXIII; Whitmore U.K. patent application No. 2,072,753A, cited above; *Research Disclosure,* Vol. 151, November 1976, Item 15162; and various patents and publications cited therein.

The invention can be better appreciated by reference to the following specific examples:

The invention, and its objects and advantages, will become more apparent in the detailed description of the preferred embodiment presented below.

Preparation of Photoresists

Photoresist formulations were prepared by dissolving the following components at room temperature in the indicated solvent. The photoresist formulations were prepared and handled in "yellow light."

| | Resist Formulation (Grams) | | |
|---|---|---|---|
| | A | B | C |
| Dichloromethane (solvent) | 182.0 | 303.0 | 135.0 |
| Acryloid ® All [poly(methyl methacrylate)] (binder) | 79.1 | 120.0 | 60.0 |
| Pentaerythritol triacrylate (photopolymerizable compound) | 35.6 | 72.0 | 0.0 |
| Pentaerythritol tetracrylate (photopolymerizable compound) | 0.0 | 0.0 | 15.8 |
| Hexanediol diacrylate (photopolymerizable compound) | 0.0 | 0.0 | 10.5 |
| Ethyl p-dimethylaminobenzoate (activator) | 5.34 | 8.1 | 4.1 |
| 3-Benzoyl-5,7-di-n-propoxy coumarin (photosensitizer) | 0.99 | 1.5 | 0.77 |
| Bis(3-t-Butyl-4-hydroxy-5-methylphenyl)sulfide (inhibitor) | 0.35 | 0.53 | 0.26 |
| % solids, based on total weight | 40.0 | 40.0 | 40.0 |

Preparation of Exposure Master

An exposure master was first prepared by exposing a high contrast silver halide photographic film (commercially available as Kodalith Pan Film 2568) through a metal microscreen with 110×110 micrometer (μm) openings and 12 μm wide walls. The microscreen was a nickel electroformed screen mesh having 8 wires/mm (200 wires/inch) sold by Buckbee-Mears Company. Upon contact exposure through the microscreen and processing a negative image of the microscreen was formed in which areas corresponding to capillaries were of maximum density and areas corresponding to lateral walls between capillaries were of minimum density.

EXAMPLE 1

Preparation of Capillary Surface Layer

The construction of an image transfer film unit was simulated by coating on a polyester photographic film support the following layers in the order numbered:

4. UV absorbing Layer: 0.54 g/m$^2$ of the UV absorber 1,1-dicyano-4-di-n-hexylamino-1,3-butadiene was coated in 5.4 g/m$^2$ of gelatin.
3. Gelatin Layer: 8.5 g/m$^2$ gelatin hardened with 1% bis(vinylsulfonylmethyl) ether based on the total gelatin weight.
B 2. Reflective Layer: Titanium dioxide, 16 g/m$^2$, in gelatin 2.6 g/m$^2$.
1. Receiving Layer: Poly(styrene-co-N-benzyl-N,N-dimethyl-N,N-vinylbenzyl ammonium chloride-co-divinylbenzene) 2.3 g/m$^2$, gelatin 2.3 g/m$^2$. Photoresist composition A, was hand coated on a coating block at 21° C. with a 12 mil (300 μm) knife over the substructure above. After setting on the block for 45 minutes at 21° C., the overcoated photoresist had a dry thickness of ~75 μm.

Samples approximately 75 mm×1.50 mm were cut and contact exposed through the exposure master for one minute using a Colight Xposer I ® as the ultraviolet light source. The exposed samples were spray-washed at 24 KPa (3.5 psi) with 1,1,1-trichloroethane for one minute. Photomicrographs of the sample indicated an open-ended capillary structure having a capillary height of 70 μm.

EXAMPLE 2

Evaluation of Capillary Surface Layer

To evaluate the effectiveness of the capillary surface layer in the simulated image transfer film unit an aqueous solution of Oxonol Red, a water soluble red dye, to which the cationic surfactant sodium octylphenyl-poly(ethyleneoxy)sulfonate, commercially available as Triton X-200, was added in an amount sufficient to adjust surface tension to 30 dynes/cm, was spread over the capillary surface layer. When the film unit was viewed through the transparent support, the dye was visible in the receiving layer; however, no dye remained in the capillary surface layer. This demonstrated that open-ended capillaries had in fact been formed. When the processing liquid was coated on a planar surface formed by the photoresist composition A, a contact angle of 15° was observed.

EXAMPLE 3

Varied Photoresist

Example 2 was repeated, but with the film unit as described in Example 1 having photoresist composition C substituted for composition A. Dye was observed to be retained in the capillaries as well as being transferred to the receiving layer. The photoresist C was substantially more hydrophobic than photoresists A and B. A contact angle of 44° was observed.

EXAMPLE 4

Varied Capillary Configuration

Example 2 was repeated, but with the film unit as described in Example 1 having a hexagonal pattern of capillaries as shown in FIG. 2. Parallel adjacent hexagonal walls of the capillaries defined a capillary width of 170 microns therebetween. The results were similar to those of Example 2.

EXAMPLE 5

Varied Capillary Configuration and Photoresist

Example 2 was repeated, but with the capillary surface layer having rectangular capillaries that extended across the entire viewing surface area of the film unit. The photoresist composition B was substituted for photoresist composition A. The aqueous dye solution was spread across the capillary surface layer parallel to the length of the capillaries. The results were similar to those of Example 2. A contact angle of 15° was observed.

EXAMPLE 6

Varied Direction of Spreading

Example 5 was repeated, but with the aqueous dye solution being spread across the capillary surface layer perpendicular to the length of the capillaries. Dye spreading was not as fast as in Example 5, but qualitatively similar results were achieved.

EXAMPLE 7

Effect of Lateral Walls on Image

To evaluate the impact that opaque lateral walls forming the capillaries would have on image quality, the exposure master was used to contact expose a second high contrast silver halide photographic element (the same Kodalith Film identified above). Upon processing this produced a photographic image in the photographic element having a maximum density in areas corresponding to capillary wall areas and a minimum density in areas corresponding to capillaries in the capillary surface layers described above.

When this second, positive exposure master was placed in contact with a Kodak Instant Color Film (PR-10) unit and the unit exposed and processed, the image pattern of the exposure master could not be detected in the transferred dye image. Some speed loss was observed, which indicated that the positive exposure master was acting like a neutral density filter. From these results it was concluded that the capillary surface layer might require some adjustment of exposure, but should not have a perceptible negative impact on the transferred image.

EXAMPLE 8

Transfer of Pre-Exposed Photoresist Layer to Film Unit

Photoresist composition A was hand coated at 18.5° C. with a 300 μm knife onto unsubbed polyester support on a coating block. The coating was dried on the block for 5 minutes at 18.5° C., then 5 minutes at 37° C., then 10 minutes at 60° C., followed by 15 minutes at 50° C. in a circulating air oven. The dry coating was peeled from the support and contact exposed on a black absorbing background to prevent halation upon exposure through the negative exposure master of Example 1. The exposed photoresist layer was positioned in a structure similar to that of Example 1, but lacking the ultraviolet absorbing layer 4, to overlie the gelatin layer 3. The photoresist layer was clamped to the film unit at its edges and spray washed for one minute. Photomicrographs of the dried sample showed an array of open-ended capillaries in the photoresist layer. The capillaries were estimated to be 70 μms in height.

EXAMPLE 9

Transfer of Capillary Surface Layer to Film Unit

Photoresist composition C was hand coated at 18.5° C. with a 300 micron knife onto a release support located on a coating block. The release support consisted of the following layers coated in the order of numbering on an unsubbed polyester film support:

3. Subbing layer formed of poly(N-isopropylacrylamide) (0.32 g/m$^2$)
2. Gelatin layer (2.2 g/m$^2$)
1. Hydroxyethylcellulose (8.6 g/m$^2$). The coating was dried on the coating block for 5 minutes at 18.5° C., then 5 minutes at 60° C., followed by 15 minutes at 50° C. in a circulating air oven. Samples of the coating were contact exposed through the exposure master, spray washed, and dried as in Example 1. The resulting capillary surface layer was then peeled from the release support and found to be easily handleable for mounting as part of an image transfer film unit.

The invention has been described in detail with particular reference to preferred embodiments thereof, but it will be understood that variations and modifications can be effected within the spirit and scope of the invention.

What is claimed is:

1. In an image transfer film unit comprised of a support and, located on said support, an imaging portion comprised of radiation-sensitive imaging means capable of providing mobile image forming material as a function of exposure and means for receiving said mobile image forming material from said imaging means to form a viewable transferred image, the improvement comprising a capillary surface layer overlying said imaging portion and forming an array of open-ended capillaries for supplying processing liquid uniformly to said imaging portion, the capillaries subtending within the image viewing area of said image transfer film unit more than half the area of said capillary surface layer.

2. In an image transfer film unit according the claim 1, individual of the capillaries subtending quadralateral areas.

3. In an image transfer film unit according to claim 1, individual of the capillaries subtending hexagonal areas.

4. In an image transfer fim unit according to claim 1, the capillaries subtending more than 70 percent of the image viewing area presented by said capillary surface layer.

5. In an image transfer film unit according to claim 1, the capillaries being less than 200 microns in width.

6. In an image transfer film unit according to claim 5, the capillaries having a height to width ratio of less than 2:1.

7. In an image transfer film unit according to claim 6, the capillaries having a height to width ratio of less than 3:2.

8. In an image transfer film unit according to claim 1, said capillary surface layer being formed from a negative-working photoresist composition.

9. In an image transfer film unit according to claim 1, the capillaries having a height of at least 5 microns.

10. In an image transfer film unit comprised of a transparent film support and, located on said support, process control layers, an image receiving layer, a liquid permeable reflective layer, a liquid permeable opaque layer, and an imaging portion layer unit including radiation-sensitive imaging means for providing mobile image forming material as a function of exposure, the improvement comprising a capillary surface layer positioned to overlie said imaging portion layer unit during imagewise exposure of said image transfer film unit, said capillary surface layer forming an array of capillaries for uniformly supplying processing liquid to said imaging portion layer, the capillaries having a width in the range of from 5 to 150 microns, the capillaries having a ratio of height to width of less than 3:2, with the minimum height being at least 5 microns, and the capillaries subtending within the image viewing area of said image transfer film unit more than 70 percent the area of said capillary surface layer.

* * * * *